US008164483B1

(12) United States Patent
Phillips

(10) Patent No.: US 8,164,483 B1
(45) Date of Patent: Apr. 24, 2012

(54) PORTABLE ELECTRO-MECHANICAL SIGNAL SYSTEM

(76) Inventor: Nathaniel Phillips, Pine Hill, NJ (US)

( * ) Notice: Subject to any disclaimer, the term of this patent is extended or adjusted under 35 U.S.C. 154(b) by 0 days.

(21) Appl. No.: 13/137,047

(22) Filed: Jul. 18, 2011

Related U.S. Application Data

(60) Provisional application No. 61/344,410, filed on Jul. 16, 2010.

(51) Int. Cl.
*B60Q 7/00* (2006.01)

(52) U.S. Cl. ..... 340/908; 40/612; 116/63 P; 340/908.1

(58) Field of Classification Search ..... 340/908, 340/908.1, 321, 331–333, 815.4, 693.2, 691.1, 340/691.4, 691.7; 40/610, 612; 362/812; 116/63 P See application file for complete search history.

(56) References Cited

U.S. PATENT DOCUMENTS

| | | | | |
|---|---|---|---|---|
| 1,779,582 | A | 10/1930 | Blesso | |
| 1,903,082 | A | 4/1933 | Senseney, Jr. | |
| 2,941,185 | A | 6/1960 | Mullikin et al. | |
| 3,886,519 | A * | 5/1975 | Hovland | 340/908.1 |
| 4,777,751 | A | 10/1988 | Pasquale | |
| 5,294,138 | A | 3/1994 | Yang | |
| 5,400,019 | A | 3/1995 | Riscoe | |
| 5,422,638 | A | 6/1995 | Singer et al. | |
| 5,959,554 | A | 9/1999 | Armstrong et al. | |
| 5,986,576 | A | 11/1999 | Armstrong | |
| 6,009,650 | A | 1/2000 | Lamparter | |
| 6,222,462 | B1 * | 4/2001 | Hahn | 340/908 |
| 6,396,395 | B1 | 5/2002 | Zielinski et al. | |
| 6,448,905 | B1 | 9/2002 | Jones | |
| 7,135,990 | B2 * | 11/2006 | Richardson et al. | 340/908 |
| 2003/0067399 | A1 | 4/2003 | Wesley | |
| 2008/0204276 | A1 * | 8/2008 | Wheaton | 340/908 |

FOREIGN PATENT DOCUMENTS

| | | |
|---|---|---|
| GB | 329149 | 5/1930 |
| GB | 2118908 A | 11/1983 |

* cited by examiner

*Primary Examiner* — Thomas Mullen
(74) *Attorney, Agent, or Firm* — Donald Grant Kelly

(57) ABSTRACT

A portable signal system for use by crossing guards, roadway construction flaggers and the like. The signal system is positioned in or alongside a roadway and remotely controllable progressively from an idle or stop mode through a warning stage and ultimately to a traffic stop mode as the signal system frontal profile greatly expands in the face of oncoming motorists. In a warning stage, the signal system presents a flashing amber light array. Following an initial warning period, articulated arms journalled on said signal system and carrying stop signal signs including red lights are swiveled outwardly to stop mode confronting motorists in oncoming traffic. A motor driven gear disk operates through pivoted drive links to control laterally outward and inward movement of the articulated arms carrying the stop signs. The system may be manually moved by handles on wheels to its operational location and anchored in place.

10 Claims, 7 Drawing Sheets

PORTABLE ELECTRO-MECHANICAL SIGNAL SYSTEM

CROSS-REFERENCE TO RELATED APPLICATION

All priority benefits are hereby claimed under 35 USC 119(e) of prior-filed Provisional Patent Application Ser. No. 61/344,410 filed Jul. 16, 2010, said provisional patent application in its entirety being incorporated herein by reference thereto and for all purposes, as if fully set forth herein.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable

SEQUENCE LISTING OR COMPUTER PROGRAM LISTING

Not Applicable

BACKGROUND OF THE INVENTION

The present disclosure relates to the management of advancing motorists in roadway traffic. The detailed discussed herein relates generally to temporarily posted signs and signals to warn and stop motorists, and deals more particularly with traffic at or near crosswalks and intersections (such as those patrolled by crossing guards), as well as roadway construction sites (typically involving flaggers). In these and similar situations, such traffic control systems serve to temporarily stop traffic by direct intervention or remote control technology to afford safe pedestrian passage and/or roadway working conditions where moving vehicles are increasingly hazardous.

Improvements in this field are long overdue to facilitate traffic control and enhance safety of pedestrians, crossing guards, and motorists, as well. In a number of situations and venues, traffic may be required to stop intermittently, for example permitting schoolchildren to traverse a roadway or enabling highway construction crews to safely work. Emergency roadway events, too, may call for traffic management so needed attention can be given to treating injured passengers and removing wrecked vehicles. Typically, crossing guards and flag-men/flag-women (herebelow referred to as flaggers) do their best to bring traffic to a temporary yet safe stop for the safety of schoolchildren, workers and motorists alike. It is well documented that such duty is not without its own risk of hazards.

National Highway Traffic Safety Administration (NHTSA) officials estimate that a pedestrian is killed by a motor vehicle in the United States every 8 minutes. More shocking still, nearly five hundred of these unfortunate pedestrians are run down every year within the boundaries of designated crosswalks - - - and these incidents include a significant number of crossing guards. Similarly, highway construction flaggers are widely recognized as holding very high risk jobs. Rising levels of fatalities and serious injuries have driven several state government authorities to initiate safety campaigns on behalf of endangered flaggers and call for increased punishment for careless drivers who place them at peril.

With respect to school crosswalks, a frequently utilized system for getting drivers' attention at critical times of day (e.g., when children arrive and depart) has included permanently mounted flashing light standards posted at corners and/or crosswalks. These routinely include electronic timers that control the system operation. Too frequently pre-set timers activate at the wrong time. This operational flaw could be a result of power failure, human programming error, daylight savings time changes or any of a number of other glitches. In any case, caution lights or stop lights can flash authoritatively from their permanent standards, though at the wrong time of day. Moreover, for a variety of technical reasons, these lights may not flash at all.

Undependable signal systems may lead to false warnings. Motorists conditioned by sporadic false warnings may be disinclined to stop and simply speed through the posted zone. One reported example relates to a country school located in Grass Valley, Calif. where, during school year 2009-2010, a problem with a system timer reportedly resulted in flashing light standard functioning properly only about one week out of thirty five. Children who depended upon system reliability were placed at considerable risk. The inherent danger of automated, but undependable, traffic control systems cannot be overemphasized.

The use of flaggers and various forms of barriers, cones or other bollards to stop, slow down, or deter traffic at road constructions sites presents similarly serious problems for workers, motorists, pedestrians and the like. Stationing live-person flaggers to control traffic flow adds significant project costs and introduces issues of human judgment and personal risk. The only viable alternative to the use of flaggers is the installation of a reliable traffic signal system. Such systems tend to be a more permanent installation, but always require tear-down and re-installation as a construction project progresses along the roadway. A unique system that would overcome these two costly alternatives and improve the ability to control traffic as it slows, stops and starts again, is very much in demand.

Throughout the world there is an outcry for vastly improved roadway, crosswalk and crossing guard systems, particularly with the following attributes: usable in differing forms of traffic control such as schoolchildren crossing and roadway construction zones; cost-effective for economically challenged local governments; dependable in life-threatening environs and over extended periods of time; easily set-up, managed and transported by a lone individual; circumvents the numerous problems associated with existing devices and technologies.

DESCRIPTION OF RELATED ART

Various devices, systems and methods are presently used to safely control traffic conditions in a variety of situations. These have proven less than satisfactory. In many situations hand-wielded signals are displayed, often as mandated by law. Such devices typically include specially lettered signs or flags (e.g., commanding: "STOP"). At school crossings, hand signs may be displayed by temporary guards or personal escorts who enter crosswalks with great caution where they wait for traffic to come to a complete stop in both directions prior to permitting children crossings. Despite the simplicity and directness of this procedure (on highways or byways), serious accidents are all too common.

At times motorists, for a number of reasons, do not see the crossing guard or construction flagger wielding the handheld sign. In fact, it is not unusual for the motorists to actually speed up to pass through an intersection (perhaps imagining existence of a grace period) so as to avoid the "annoyance" of having to stop. Obviously, crossing guards and flaggers who step into oncoming traffic patterns face inherent dangers when they bravely challenge motorists to stop. Children or other pedestrians and roadway repair workers who must trust the traffic manager's directions also are in jeopardy.

To suggest that a hand-wielded stop sign is both dangerous and woefully inadequate for a school zone crossing or a construction flag person's post would be an understatement. As mentioned above, climbing injury and fatality rates clearly indicate the currently ubiquitous traffic control protocols to be woefully outdated. Because of one or more shortcomings, innovators' attempts to improvise more effective and dependable traffic control systems have met with little or no success. The following are examples of patent documents reflecting earlier attempts.

Wesley's US Published Patent Application No. 2003 0067399 presents a "smart" traffic services platform wherein a portable stop sign includes a bank of lights. The lights can be selectively activated or flashed in a pattern as a visual display of an array of LEDs and are controlled remotely by a computerized signal, and pre-set for time of day activation. While the Wesley publication is viewed as considerably informing with respect to remote control systems, the disclosure falls short of teaching how such as system can be easily positioned and removed from a display site, and is generally silent as to important mechanics of operative movement, if any.

Senseney, Jr., in U.S. Pat. No. 1,903,482 illustrates an early form of portable road sign featuring an articulated arm. On an upper end of the arm is affixed a plate carrying the word "stop" or the like. At a lower end of the articulated arm is affixed an oil or electric lantern. The articulated arm is swung back and forth in a waving motion simulating the swinging of a lantern by a man. The mechanism for movably swinging the arm is a hand-cranked spring motor positioned in a housing base.

In terms of "portability," inventors Senseney, Jr. et al. suggest this unit would be transported on a wreck-car (tow truck) summoned to a car wreck scene. The unit is then hand-carried from the truck and positioned near the wreck site as a safety measure. In essence, the Senseney Jr. device, when in its singular operative mode, is merely duplicative of a human waving a lantern for the purpose of stopping traffic.

Compared to the present invention, as discussed below, the Senseney, Jr. device. is viewed as awkward and challenging to deploy since it must be physically carried from a vehicle to its operating position. Again, the Senseney, Jr. device, unlike the present invention described herebelow, displays a single dimension operative mode; that is, the activated device is confined to simply waving a lantern without allowing for mode change or remote control (to address the changing requirements), and without any way to effect a alter in its profile as viewed by oncoming drivers.

Pasquale, in U.S. Pat. No. 4,777,751 describes a portable illuminated signal-"person station" comprising a platform equipped with lights, reflectors, and stop sign. This signaling station is principally configured to accommodate a standing person (physically positioned on the platform). Pasquale's platform would be rolled or wheeled into place on base-mounted wheels. Purportedly this patented device may be used at a school crossing or road construction site.

The profile of the Pasquale signaling person station must be at least as wide (probably wider, in fact) as the physique of a typical adult human, unlike the purposefully changeable profile set forth in the present invention disclosure. The Pasquale station does not suggest remote control requirements, nor does it accommodate changing light system requirements or options.

U.S. Pat. No. 5,422,638 granted to patentees Singer et al. illustrates a stand for a remotely operated road sign. A dual stop/slow sign device is remotely controlled electronically so as to turn the device to afford alternatively viewing the words, SLOW and STOP from opposite directions. The Singer et al. device further includes wheels which can be moved out of road surface engagement when operated as a traffic control device. This device further presents a sizable, essentially fixed profile to oncoming traffic when deployed. In other words, this would not be appropriate for mid-roadway deployment. A strobe light is accommodated the stabilizing base, but this not contemplated to move flashing lights into and/or out of approaching drivers' view as featured in the present invention to be discussed herebelow.

U.S. Pat. No. 5,959,554 issued to Armstrong et al. comprises a traffic management system featuring a dual sign system in the form of two physically distinct units, electronically interconnected. Such units are to be spaced apart at a first and second end location of a construction zone. The Armstrong et al. device further includes alternatively viewable stop/go signs and a remote-controlled motor (powered by portable batteries) for turning the signs respectively to angular positions alternatively signaling drivers to stop or go.

The Armstrong et al. disclosure makes it clear that the "signs" may also be embodied as light boxes. These units apparently are physically transportable to individual work stations, but are not apparently "mobile" per se. Moreover, the units include no signal lights to warm drivers of an impending stop mode, and are seen as incapable of presenting an altered profile (i.e., selectively made more or less obtrusive to oncoming traffic).

Yang's traffic control cart, for which the inventor received U.S. Pat. No. 5,294,138, includes a rolling wheel assembly comprising a base fixed on the rolling wheels, a column mounted on the base, an arm pivotally secured on one periphery wall of the column, a light device including at least a green light, a yellow light, and a red light being mounted on a top face of the column. Yang's pivotal arm is allowed to reciprocate in a ninety-degree range from vertical position to horizontal position. In the meanwhile, one color of the traffic lights is "on" thus controlling traffic there-around.

The Yang system is essentially a serially controlled light signal device similar to a ubiquitous traffic controlling stop light unit (typical of traffic intersections), but mounted on a cart rather than on a corner pole or overhead suspension wires. Yang's system lacks the operational dynamics of the present invention wherein arms are articulated laterally to broaden the unit's visible profile to oncoming motorists, presenting a highly visible traffic control system emboldened with authority by flashing lights to warn and stop traffic in a clear, orderly and safe manner.

A portable traffic control device is presented by patentee Riscoe, Jr. in U.S. Pat. No. 5,400,019, and described as for temporary deployment. The Riscoe, Jr. device includes an adjustable/collapsible tripod stand and electrical control circuit capable of both automatic and manual operation. A portable traffic-control device raised or lowered by hand includes a horizontal boom which folds down to a vertical position. Once deployed into its raised position, the Riscoe, Jr. device is operated in stop/go mode alternatively much the same as a standard traffic stoplight.

In contrast to the Riscoe, Jr. innovation, the present invention discussed in detail herebelow, swings its signal arms laterally forward into stop mode, immediately presenting a noticeably widened profile and flashing lights. On remote command, following activation the present invention, the present invention can be made to retreat (from stop mode) by swinging its signal arms laterally backward into a "parked" position.

U.S. Pat. No. 6,396,395 was granted to Zielenski et al. for a programmable vehicle stopping system. This system which is configured as operatively components of a bus-type motor vehicle includes red and yellow flashing lights along with an outwardly swinging stop sign. The traffic control devices are automatically remotely controlled. yellow lights mounted on the bus cab are disclosed as a warning signal; red signals, stop. A mechanical sign interconnected to a side of this bus swings into oncoming traffic pathway to ensure approaching vehicles stop prior to children crossing the roadway. Related to the Zielenski et al. system, Lampater's U.S. Pat. No. 6,009,650 illustrates a detailed lighted octagonal stop sign to be pivoted away from the side of a bus and into position to stop traffic for children crossing a roadway or otherwise boarding/de-boarding the bus.

Unlike the invention disclosure discussed herebelow, the signal systems of the Zielenski et al. and Lampater patents lack a number of distinguishing features. Not suggested is a portable, freestanding signal configuration with laterally moveable arms and dual signage considerably enhancing the operable profile confronting oncoming motorists. Further, there is no suggestion or motivation in the Zielenski et al. and Lampater disclosures prompting a skilled artisan to equip known free standing traffic control systems with the hinged stop signs commonly found on school buses.

Armstrong's U.S. Pat. No. 5,986,576 (referred to herein as Armstrong '576) teaches the deployment of a remote controlled, portable signaling device and a plurality of warning flashers. The Armstrong '576 device further includes a signal head with LED display and microprocessor. A device base unit serves to store a power source while plural warning flashers (include highly luminous LEDs) serve to warn passersby of the presence of the device.

Armstrong '576 is configured as a typical 4-way stoplight signal unit with a fixed profile as viewed by approaching motorists. Unlike the present invention to be discussed herebelow, Armstrong '576 does not afford or suggest capability of substantially widening its warning presentation profile as by (the present invention discussed below) laterally swinging the flashing light signal signage generally into the path of (i.e., facing) oncoming traffic, then subsequently permitting traffic flow by retracting said signage into inoperative position.

A robotic traffic signally device illustrated in Jones' U.S. Pat. No. 6,448,905 purportedly reduces need for deploying workers at construction sites. The Jones signaling device includes a weighted base resting on the ground. On said base is securely mounted a "statue-like" member simulating a human figure wearing a hat. The robotic human-like device further includes a hand-like holder for an upwardly extending sign post featuring a reversible stop/slow sign.

Jones' internal mechanism is remotely controlled on user's command to rotate the sign from stop to slow to stop. Arrays of light-emitting members are deployed about the sign and statue. Unlike the present invention disclosure, Jones' weighted base member is not mobile and the profile of the overall device is not variable for purposes fully detailed herein.

U.S. Pat. No. 2,941,185 granted to Mullikin shows a portable traffic signal system particularly designed for use near schools to manage street crossings. The signal system is essentially a standard traffic light (e.g., a typical multiple directional stoplight encountered at street traffic intersections) stored in a portable box. The signal system is transportable within its container box to multiple locations as needed. The self-storage box is mounted on lower wheels and moveable to its appointed location. At its operational site, the storage box is opened to permit the signage to be swung upwardly from its telescoped storage mode to a vertically standing operative position where it can be controlled from a remote position to avoid injury to the operator.

The Mullikin system includes the typical multicolored lights or lamps (green, yellow, red) according to multidirectional traffic controls. The signal lamps may be operated by a remote switching device. In contrast to the present invention disclosure that follows herebelow the Mullikin system does not include, among other missing features, a dynamically expandable profile to more effectively address oncoming traffic. More specifically, there are no laterally swinging arms/signs etc. moveable into operational position and subsequently retracted on command.

Moulton's Great Britain patent document GB329,149 presents a signaling device specifically for controlling traffic on roads undergoing repair. The signaling device includes a portable, vertical pillar supporting at its top a box bearing a sign denoting "STOP" on 3 faces and "GO" on the fourth face. The box is rotated manually by a handle. On the "STOP" sides of the box, red glasses (lenses) are presented; green glasses (lenses) on the "GO" side. Clearly, unlike the present invention, Moulton does not include a mobile unit wherein the traffic-addressing profile is broadened by laterally swinging arms with flashing signage. Nor does Moulton suggest remote controls.

Firth's Great Britain published patent application number GB2118908A involves deployment of warning devices. Specifically, Firth describes a signage transporter for the deployment of a variety of warning devices at an accident scene or like emergencies. Firth's transporter is a wheeled conveyance configured to be folded into a police car boot, and includes storage capacity for multiple lamps, bollards, cones and signs for traffic control. The conveyance includes a frame, handles, a cone receiving spigot and containers for the warning devices. At an accident site, the transporter is carried by its lift handles from the boot and wheeled into position by a push handle means. Selected lamps, signs, cones and such are removed therefrom and strategically positioned along the roadway.

Firth's specification describes the transporter itself as convertible to a stand-alone signal display system featuring upwardly/downwardly pivotal and upwardly/downwardly extendable lamps. It is further configured to display temporary signage (e.g., "POLICE," "SLOW"). At the wreck site, the Firth conveyance may be turned (manually tilted over) such that its wheels are clear of the ground such that the frame is stationary. A warning display board may be mounted on the frame in a visibly prominent display of "POLICE" or "SLOW." The Firth transporter further includes a foldable support plate with rigid, pointed protrusions that can be forced into soft ground at the side of the roadway thus anchoring the transporter against movement caused by wind.

However, unlike the present inventive disclosure, Firth's wheeled device does not suggest lighted signs on articulated arms mounted to be extended laterally and outwardly as a "stop" command for oncoming traffic, then subsequently retracted or folded laterally inwardly to permit traffic to "go."

The apparent widening of the presently presented warning system evolving into "STOP" mode, as viewed from the perspective of an approaching motorist, adds heightened awareness of the motorist's need to come to a full stop. Moreover, Firth presents only a manually adjusted mechanical construct without motorized parts or remote controls.

Thus, the world's patent literature currently reflects considerable inventive activity with respect to mobile or transportable traffic control systems configured to temporarily stop or slow traffic, and particularly in the interest of pedestrians nearby. To date, for any of a variety of reasons, none is known to have been particularly commercially successful. The mobile remote controlled electro-mechanical signal system of the present invention overcomes various problems associated with current technologies.

BRIEF SUMMARY OF THE INVENTION

The signal system configuration in detail herebelow assures timely slow/stop signal recognition and reaction by approaching motorists in vehicles traveling along a roadway. The thoughtful construct and dynamic mechanization set forth in this disclosure promote sufficient traffic stopping time before a child crosses a roadway intersection or before roadway workers enter harm's way. Unlike earlier transportable traffic control units and hand-wielded signs, the unique system presented herein is easily placed into position. Moreover it is uniquely configured and operable to become increasingly prominent (i.e., physically wider) in terms of viewable profile and illumination impact during its remotely controlled, multi-staged signal phases in the face of oncoming motorists.

Uniquely, this signal system affords numerous advantages:

1) a clear, mechanized signal signage that is freestanding and can be seen and unmistakably interpreted from a considerable distance;

2) a steadily enhanced or broadening physical presence viewed by motorists approaching in vehicles along a roadway particularly when the system functions sequence from inactive or "parked mode" to a "full stop mode;"

3) a distinct warning stage clearly illuminated by warning lights (for example typically yellow in color) universally familiar to motorists and pedestrians alike;

4) a clearly defined stopping stage earmarked by lights universally associated with traffic stopping controls;

5) a dependably controlled signaling sequence with timed stages helping motorists and pedestrians to attune themselves to signage system operation timing and to react accordingly;

6) a simple, easily managed remote control device commanding all system functions from a safe distance.

Generally speaking, the present invention includes a flashing light warning system that alerts approaching motorists of an impending requirement to stop. The system controls may be remotely directed electronically by a (human) signal manager. The signal manager assures that the system performs in a timely manner. In other words, prompt and proper activation is under complete control and supervision of the signal manager (by way of example only, a school zone crossing guard or construction zone flagger).

Activation and de-activation of this unique system may be managed by remote control (handheld RF unit) from a safe location (e.g., a user could be positioned on a nearby street corner or in a parked roadwork vehicle). This advantageously avoids the high risk presently faced by crossing guards and construction zone flaggers stepping into oncoming traffic. Utilization of the present invention will substantially reduce accidents and injury to children, pedestrians, crossing guards, flaggers and motorists.

The system is relatively light weight and readily transportable for rapid installation (even anchored in place where necessary) for immediate activation. As an auxiliary feature, the signal system includes a unique lock-down mechanism to secure for safe operation. Upon completion of operation, the mobile system may be quickly shutdown and withdrawn, transported, redeployed or stored for reassignment and battery re-charging.

Besides its primary benefits realized in avoiding loss of lives and disabling injuries, extended benefits of the present invention will include: reduction of liability insurance rates; facilitation of safe, prompt crossings by schoolchildren, ensuring safe passage and reduced tardiness; and a safer working environment for crossing guards as well as road repair/construction crews. While the distribution of the present invention may be targeted mainly for schools and construction zones, highly efficacious application is anticipated for a multitude of other locations including but not limited to: high-traffic factory floors, airport tarmacs; busy storage facilities; shopping malls; and convention centers.

With respect to the detailed disclosure that follows, an overall objective is to illustrate the preferred embodiments and broadly state the methodologies that may be used in order to consistently and concisely warn motorists to decelerate and stop at crosswalks or other roadway areas where pedestrians or workers may be endangered.

DETAILED DESCRIPTION OF THE INVENTION

Figure 1:
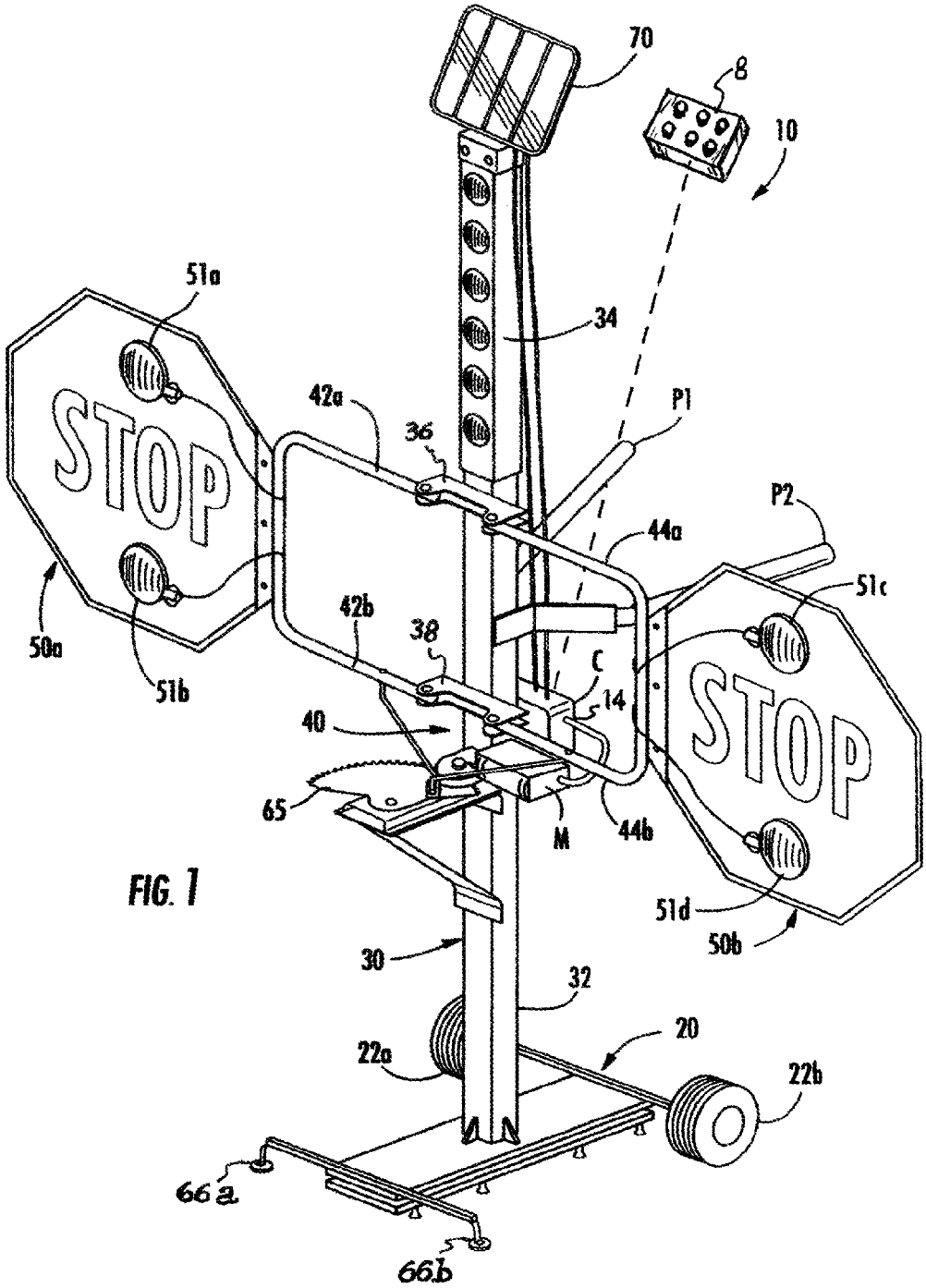
FIG. 1 is a top perspective view of the mobile remote controlled electro-mechanical signal system in full display mode.

In FIG. 1 the present invention, referred to herein as freestanding, portable (i.e., easily moved by hand) remote controlled electro-mechanical signal system 10 (or simply, signal system 10), is depicted as including base 20 equipped with at least one wheel 22*a*, 22*b*. Signal system 10 structure further comprises a substantially vertical stanchion or tower 30 affixed to said base 20. Tower 30 is structurally defined by a lower portion 32 and upper portion 34. Prominently on said tower 30 upper portion 34 first side (also known as the "display side" and best viewed in FIGS. 1 and 4B), at least one warning light 52 (see also FIGS. 4A and 4B) is disposed so as to form an illuminated upper portion 34. Of course multiple warning lights will likely prove more effective in forming a lighted section of said tower 30 upper portion 34.

By way of example, a substantially vertical array of warning lights 52*a*, 52*b*, 52*c*, 52*d*, 52*e* and 52*f* may be displayed (See FIG. 1, 4A, 4B). Warning lights 52*a-f* are typically yellow or amber - - - both colors widely associated with a caution directive or warning. Warning lights 52*a-f*, however, could project other colors or could be relatively colorless depending on the anticipated signal system 10 application. More will be discussed about these warning lights 52*a-f* herebelow.

Stanchion or tower 30 is structurally interconnected to its base 20 so as to have said display side facing (or projected) in a first direction (typically opposing any oncoming vehicle traffic requiring management). The second or reverse side of tower 30 faces (or projects) in a second direction generally opposite said first direction, and typically essentially in line with, or parallel to, vehicle traffic passing signal system 10 tower 30.

At least one additional warning light, not shown but optionally similar to lights 52*a-f*, may be positioned on a reverse (or second) side of said tower 30 upper portion 34, opposite said first side. Again, while not shown, six warning lights (as for example only) could be located on said second side of upper portion 34 of tower 30. In other words, the tower 30 first and reverse side may be substantially identically equipped. The actual number of warning lights on either side of tower 30 is not critical as long as a suitably visible warning signal is projected. Local governing authorities may have regulations governing conventions in this regard. Positioned on said tower 30 at or near the joinder of upper and lower portion 34, 32 is a swivel casing 40, the function of which will now be described.

Swivel casing 40 essentially comprises collaborating journal or paired pivot elements (e.g., brackets 36 and 38) affixed to said tower 30 in joint support of articulated arms 42*a*, 42*b* and 44*a*, 44*b*. Proximate ends of said arms 42*a,b* and 44*a,b* are mounted respectively on said brackets 36 and 38 for swiveled movement. Arms 42*a,b* and 44*a,b* are fabricated as rigid but lightweight tubular material to minimize structural weight and wind resistance. As a choice in mechanical design, arms 42*a,b* may be integrated as a continuous U-shaped construct. This is true of arms 44*a,b*, as well.

Figure 4A:
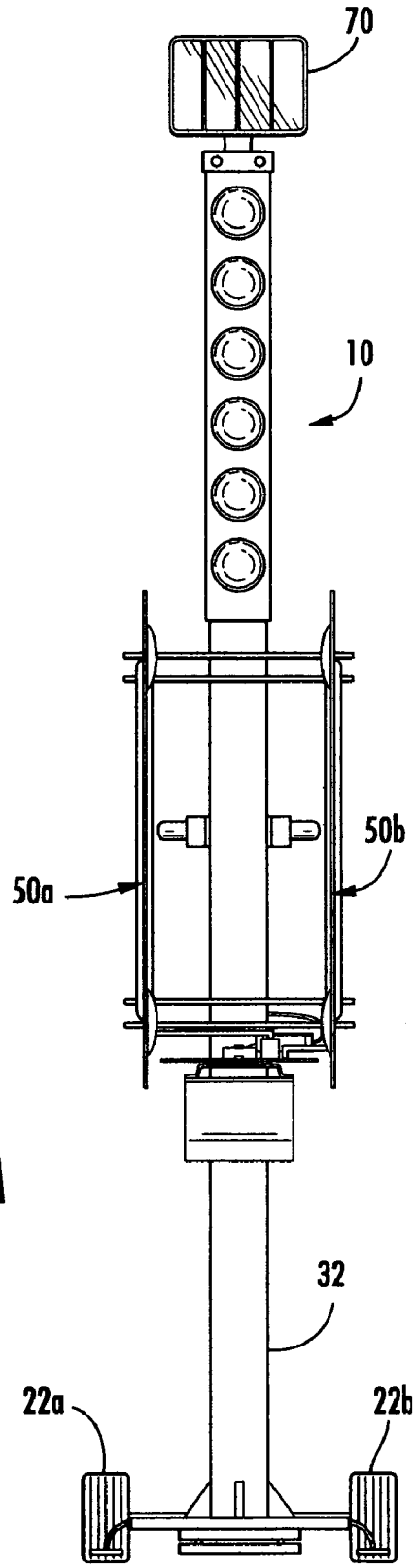
FIG. 4A presents a front elevation of the electromechanical signal system in its inactive mode with no lighting displayed.

Said arms 42*a,b* and 44*a,b* are constrained for swiveled movement between a folded or "park mode" position and an extended or "stop mode" position. In said park mode, distal ends of said arms 42*a,b* and 44*a,b* are disposed relatively adjacent to each other generally along said first signaling direction. The park mode position defines said signal system 10 as presenting a first, relatively narrow frontal profile width in said first signaling direction. This narrow frontal profile is designated as front elevation FIG. 4A. Widening or spreading to its stop mode position, distal ends of said arms 42*a,b* and 44*a,b* are swiveled away from each other in a direction substantially perpendicular to said first signaling direction. Said stop mode position defines a second frontal profile width of said portable signal system 10 depicted as the FIG. 1 perspective. The second frontal profile (FIG. 1) is significantly greater than said signal system 10 first frontal profile width (FIG. 4A). In signal system 10 park mode, stop signal sign devices 50*a* and 50*b* (described in more detail herebelow) respectively carried by arms 42*a,b* and 44*a,b*, are substantially un-viewable (FIG. 4A) by approaching motorists on said roadway. Contrastingly, in stop mode, said signal sign devices 50*a,b* are fully viewable (FIG. 1). This avoids motorist confusion.

Each said articulated arm 42*a,b* and 44*a,b* (as mentioned hereabove) carries at least one signage device substantially at its distal end, for example stop signal sign devices 50*a* and 50*b* respectively. Said stop signal sign devices 50*a* and 50*b* may embody a widely used octagonal "STOP" sign configuration as illustrated in FIG. 1. Still, within the present invention scope defined in appended claims, the stop signal sign devices 50*a* and 50*b* may be given alternative configurations (depending on local language, convention or other standards).

Said stop signal sign devices 50*a* and 50*b* may advantageously include at least one flashing stop light (depicted in FIG. 1) as including multiple lights 51, including stopping lights 51*a*, 51*b* positioned on signage device 50*a* and stopping lights 51*c*, 51*d* on signage device 50*b*. Similar flashing stopping lights (though not shown) may optionally be situated on reverse sides of said signal sign devices 50*a*, 50*b*. Identical or substantially similar signs or signage features may be provided on reverse sides of devices 50*a,b* such that the system can be utilized to halt traffic in both directions along said roadway.

To reinforce the "STOP" command to be conveyed by stop signal sign devices 50*a*, 50*b* it is suggested that said lights 51*a-d* be red in color. Again, as local convention may dictate, other colors (than "red") may be preferred. The actual number of flashing stop lights on either side of said stop signal sign devices is not critical as long as a suitably visible stopping signal is projected toward oncoming traffic on said roadway. All lighting and sign/signage articulation functions may be controlled from a remote electronic transmitter 8 in communication with a centrally located control unit C as best viewed in FIG. 1 and diagrammatically depicted in FIG. 6.

Control unit C may be affixed to stanchion 30 where it is electronically associated with a power source battery 12 positioned therein (FIG. 6) or nearby. The battery 12 must be suitably sized for energizing motor M output drive 60 and flashing lights 51*a,b* and 52*a-f*. All said lights (51*a,b* and 52*a-f*) may be interconnected to the control unit C and battery 12 therein by wiring (conventional and not shown) running along (outside or inside) tower 30. An optional solar panel 70 is depicted in FIGS. 1, 4A, 4B and 6, and purposed for charge maintenance of battery 12. Battery 12 may be replaced by any equivalent form of power source capable of supplying electricity to the various lights or activating the stop sign articulation means illustrated in FIG. 3. For example, in some venues the electricity requirements may be supplied directly (i.e., hardwired to a power-company grid source).

Control unit C includes a transmission receiver 14 (for remote RF transmissions) and signal system 10 controlling elements in the form electronic switches S. Said switches S dictate system 10 operations as commanded by a remote control RF transmitter 8 unit (FIGS. 1 and 6) activated by a crossing guard, flagger or other remote operator from a safe distance. A primary function of control unit C through its receiver 14 is to initialize and operate power flow and signage articulation. For example, when the traffic manager judges it desirable to bring oncoming traffic on said roadway to a halt, appropriate electronic signals may be transmitted to receiver 14 from transmitter 8 to activate signal system 10 components via electronic switches S.

Commercially available RF wireless remote control switching units are readily adaptable to the portable electromechanical signal system presently disclosed. By way of example only, all management functions can be executed from a distance of up to 100 meters with suitably configured model H290407729895 presently available from Light-in-The-Box Corp. (see world-wide web for details). This and other similar RF remotes provide multi-channel signals and further offer multi-bit address code encryption. Advantageously, encryption capability can help avoid signal system 10 operation hacking and hijacking.

Figure 4B:
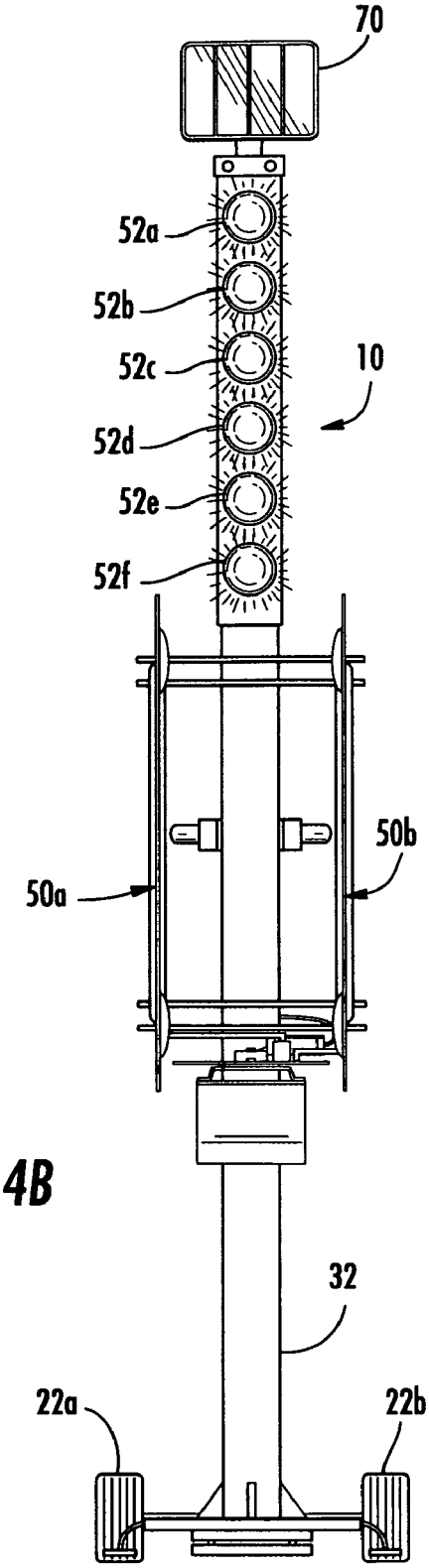
FIG. 4B is a front elevation essentially identical to FIG. 4A, but depicting an initial warning stage wherein warning lights are activated and illuminated.

Upon warning stage activation illustrated in FIG. 4B, (amber) warning lights 52*a-f* begin to flash (by design choice, optionally in sequence or unison) for a pre-set time period. Following the warning stage, said arms 42*a,b* and 44*a,b* of swivel casing 40 are motor-driven via motor output drive 60, gear plate 65 and drive links 62, 64 further described below, in response to remote control or timer. Arms 42*a,b* and 44*a,b* proceed deliberately swiveling outwardly to a full stop mode position depicted in FIG. 1, so as to be disposed generally perpendicular to said first and second directions mentioned hereabove. In the full stop mode position, said arms 42*a,b* and 44*a,b* are oppositely, outwardly extended in a traffic blocking position. This stage presents a markedly expanded signal system 10 profile as described above and depicted in FIG. 1, and compared to the narrower signal system 10 profile presented in FIGS. 4A and 4B.

In typical use the signal system 10 would be poised at or near a roadway central area. Approaching motorists along said roadway will have an initial view of signal system 10 (in parked or idle mode) as a remarkably narrow vertical stanchion 30 topped by an upwardly extended light section and optional solar panel 70. As described hereabove, signaling activity begins on command with flashing (yellow) warning lights 52*a-f*. Following a warning stage of (perhaps) several seconds, advancing motorists in vehicles along said roadway will be confronted with unfolding stop signal signs 50*a*, 50*b* substantially widening toward the roadway. As signal system 10 evolves into its full stop mode with frontal profile significantly expanded, red lights 51*a-d* begin flashing in lieu of the warning yellow lights 52*a-f*- - - and now fully viewable by advancing motorists along said roadway.

Thus, as swiveling arms 42*a,b* and 44*a,b* reach full stop mode position with red lights 51*a-d* boldly flashing, the initially narrow signal system 10 is seen (from the approaching motorists' perspective) as having expanded its frontal facing profile (and, metaphorically, its authority) by as much as 300% (comparing FIGS. 4A and 1).

With traffic slowed to full stop, the traffic manager (crossing guard/flagger) can declare the roadway safe for pedestrian/worker entry. In its imposingly broadened stance, signal system 10 continues its "STOP" flashing mode until remotely commanded to return its operational mode to "PARK." During, or at the termination of, receding motion of swiveling arms 42*a,b* and 44*a,b* to their folded position all lights (i.e. 51*a-d* and 52 *a-f*) are extinguished. Once the signal system 10 has reverted to its initial narrow, non-illuminated profile, traffic movement along said roadway is resumed.

Switch elements, not shown but considered conventional, may be deployed strategically to control the various lights during staged movement of arms 42*a,b* and 44*a,b*. For example, retraction movement of arm 42*a,b* into STOP and/or PARK position can simultaneously trip a limit switch (see switching example discussed below). Alternatively, a timer initiated when warning lights 52*a-f* are energized could be dictated by a pre-set sequence to switch to red lights 51*a-d* at any pre-selected point of arm 42*a,b* and 44*a,b* motion.

Signal system tower 30 may include one or more optional push handles P1 and P2 to facilitate manually tipping and moving signal system 10 thus making it easily transportable on wheels 22*a*, 22*b* to and from its operative location or storage. Also affixed to tower 30 is a system control box C (FIGS. 1,2) through which electro-mechanical aspects of the signal system 10 are managed.

Generally speaking it is desirable to have the described portable electro-mechanical signal system 10 fabricated of lightweight, yet durable material in order to facilitate transportability and maintain long term durability. For example, tower 30 may be made of a relatively lightweight tubular steel or aluminum, or from relatively durable thermoplastic. In any case, base 20 would typically be a heavily weighted base rendering the tower suitably stable to handle adverse weather and wind conditions. As further safeguard against sudden tipping, signal system 10 may be made adaptable to a number of system "lock-down" devices. Specifically, base 20 could include structural apparatus configured for direct attachment to underlying substrate such as roadway pavement.

A novel approach to "lock-down" would provide base 20 with a retractable electromagnet locking plate 80 (FIG. 5) structured for engaging and magnetically attaching itself to a fixed, ferrous (ground) plate 84. Such plate 84 could be previously installed or anchored (as, for example, by pavement spikes or screws 81) at a preselected signal system working location. Obviously, a steel manhole cover plate could suffice if favorably located.

Figure 5:
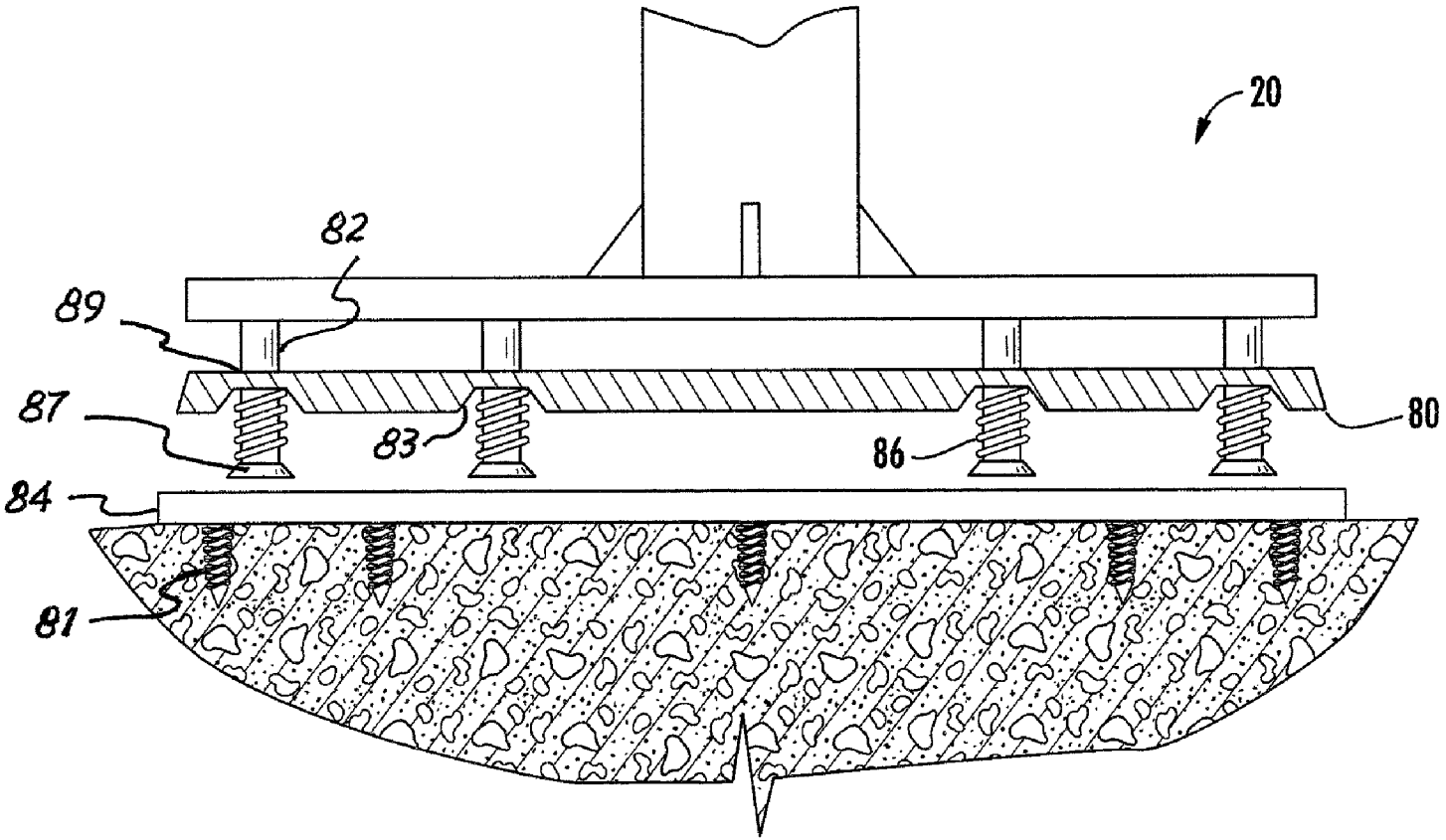
FIG. 5 is a partial front elevation of the signal system base showing a sectional view of a base lock-down option.

As an anchoring device example, illustrated in FIG. 5, the signal system 10 is illustrated (in part) as positioned over a ferrous plate 84 firmly anchored by screws 81 to roadway pavement or other substrate. Stanchion 30 base 20 is modified to include a lower surface with at least one bolt or pin 82 extending downwardly therefrom. Each said pin 82 terminates in an enlarged lower pin head portion 87. A compression spring 86 is provided about each said pin 82 so as to be supported by the pin 82 enlarged head portion 87. An electromagnetic plate 80 includes at least one pin passage 89 therethrough loosely assembled on said pin 82 so as to rest on spring 86. Under normal conditions, electromagnetic plate 80 is supported only by a lifting spring force exerted by compression spring 86. The electromagnetic plate is interconnected to the battery 12 within control unit C.

When energized by the battery 12 in control unit C, a resultant magnetic effect empowers electromagnetic plate 80 to overcome the lifting force of compression spring(s) 86 so as to directly engage with said ferrous plate 84 firmly anchored at 81, as pin 82 head portion 87 nests within recess 83 of ferrous plate 84. Signal system 10 is thereby locked-down until deenergized for release. Effectively anchoring signal system 10 to a working location is particularly helpful in avoiding unwanted toppling caused by prevailing winds, passing vehicle breeze, or brought on by slanted terrain at its assigned station.

Other mechanisms can be deployed for effecting electromagnet locking. For example, the locking plate 80 could be mechanically moved into direct engagement with plate 84 by a threadably engaged rod and block (not shown) located within lower tower/base 32/20 effected through hand-crank (not shown) or suitable motor M interconnection. When engaged, the electromagnetic plate 80 would be energized through its interconnection with the power source battery 12 in control unit C.

System wheels (illustrated for example as 22*a* and 22*b*) could be one or more in number adequate to easily transport the mobile signal system 10 as desired. For instance, one or more wheels 22 could collaborate with one or more ground-engaging support feet 66*a* and 66*b*. Moving the signal system would merely require that it be tipped slightly, thus raising feet 66*a* and 66*b* so as to be supported on said wheels 22 and easily mobilized in its tipped mode. Said wheels 22 and feet 66*a* and 66*b* may also be retractable (not shown) by conventional means such as by being threadably engaged to the base 20 enabling signal system 10 base 20 to rest directly on the ground for added stabilization.

Stop signal signs 50*a* and 50*b* must of course meet any legal standard or convention under governing authorities. Stop signal signs 50*a*, 50*b* and associated arms 42*a,b* and

44*a,b* can be fabricated of any durable, high-strength material (steel, aluminum, or carbon fiber and so forth - - - tubular, stamped or otherwise formed). Each arm 42*a,b* and 44*a,b* must of course be capable of operatively supporting its associated stop signal signs 50*a*, 50*b*, etc. in outwardly extended and forwardly folded or parked disposition as depicted in FIGS. 1 and 4A. It is also noted that associated with swivel casing 40 elements is a unique mechanical mechanism for opening and retracting a stop sign or signs 50*a* and 50*b* etc. on command. This mechanism will now be described in detail.

Figure 2:
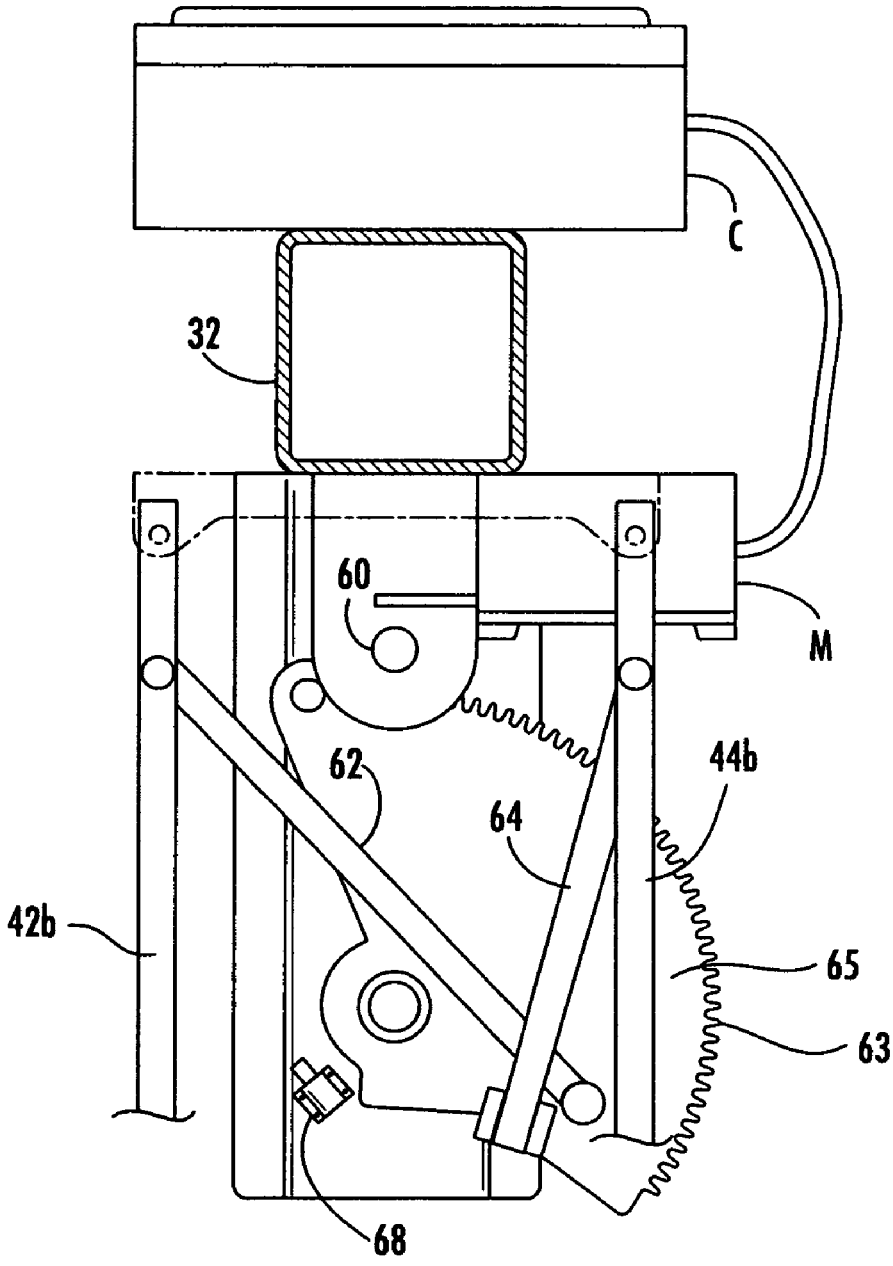
FIG. 2 is a partial plan view of the unique sign articulation mechanism for the signal system depicting the signal system in inactive or parked mode.
Figure 3:
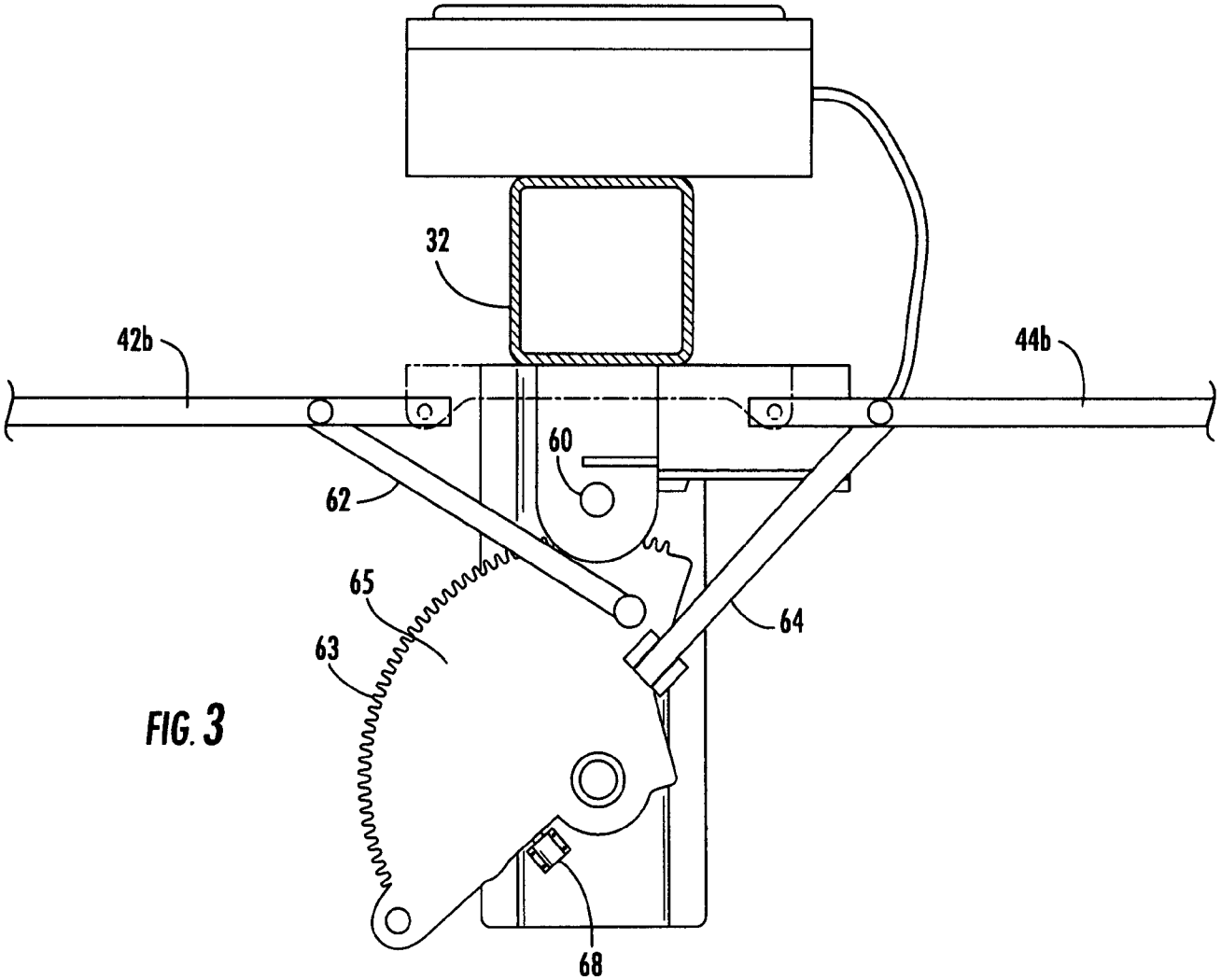
FIG. 3 is a partial plan view similar to FIG. 2, but depicting the articulation mechanism repositioned to place the signal system in full display mode.

Illustrated in FIGS. 1-3 is electric motor M secured to signal system 10 tower 30 and drivingly engaged via gear output drive shaft 60 to a gear plate 65. Said gear plate 65 includes conventional gear teeth 63. Both output drive shaft 60 and gear plate 65 are rotatable about generally vertical axes. Gear plate 65 includes first and second drive links 62, 64 respectively pivotally interconnected to sign holding arms 42*b* and 44*b*. Each said link 62, 64 is secured at its proximate end to said gear plate 65 and drivingly connected respectively at its distal end to said sign holding arms 42*b*, 44*b*.

As the motor M is powered by the remote transmitter 8 signal acting through receiver 14, the motor M output drive shaft 60 drivingly engages gear plate 65 to drive movement of drive links 62, 64 respectively moving arms 42*b* and 44*b*. As said arms 42*b*, 44*b* swing outwardly on brackets 36, 38 from their parked or folded position to an extended stop position, the stop signal sign devices 50*a*, 50*b* are moved into signaling position as depicted in FIG. 1. On a reverse command from transmitter 8, the arms 42*b* and 44*b* carrying associated stop sign devices 50*a*, 50*b* are returned by said gear plate 65 to their initial parked position. Limit switch 68 depicted in FIGS. 2 and 3 as directly in the path of gear plate 65 leading edge will immediately energize lights 51*a-d* when stop sign devices 50*a*, 50*b* are in signaling position. Upon return to parked position, a second limit switch (not shown) could be positioned to engage another edge of gear plate 65 to stop motor M output drive shaft 60, or shut down the entire system 10. Strategically placed switches similar to switch 68 can play a number of useful roles in component control.

While FIGS. 1 and 4A illustrate the arms 42*a,b* and 44*a,b* as articulated forward only, it should be understood that similar results can be gained by configuring the arms 42*a,b* and 44*a,b* to articulate rearward of stanchion 30. Of course, push handles P1, P2 would have to be repositioned or reconfigured to accommodate such an alternative formulation. The stop signal sign devices 50*a*, 50*b* are depicted as traditional stop signs but may, as venue objectives dictate, present any of a variety of shapes or topical messages. This unique signage may, in fact, embody electronic texting messages specific to changing roadway conditions.

Warning lights in amber or yellow (or other suitable color under convention standards) exemplified as illuminated in FIG. 4B as 52*a-f*. In any appropriate number, these lights are typically constructed of well-known durable light elements or components suitable for flashing. Such illumination unit may comprise colorless incandescent, LED, or other type of white light enclosed by amber, yellow or other color lenses. Generically, lights 52*a-f* may simply be referred to as "warning lights." Similarly, flashing stoplight/lights (e.g., 51*a,b* and 51*c,d*) attached to stop signs 50*a*, 50*b* respectively could be constructed of any suitable type or size light component in order to present an effectively flashing red light. Alternatives to a red color may be dictated by local convention or traffic authority regulation). Thus, generically, flashing signal elements 51*a-d* may simply be referred to as "stop lights."

Figure 6:
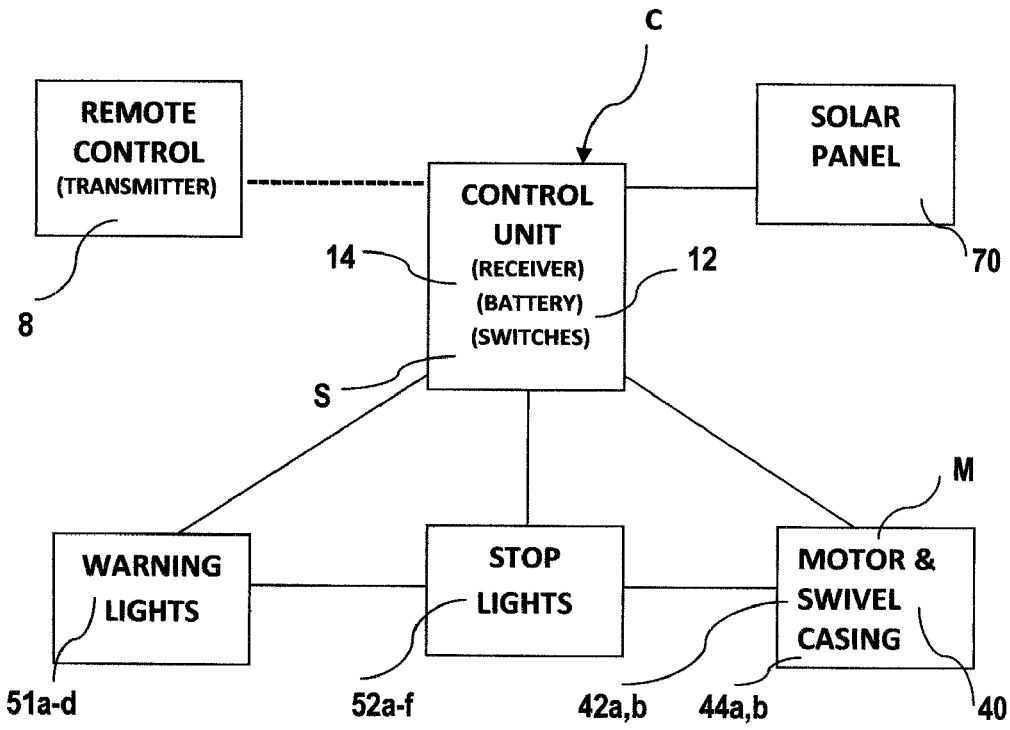
FIG. 6 is a block diagram depicting the interrelationships of the signal system components.

As an optional feature, signaling system 10 may include multiple limit switches for managing lighting and mechanical movement sequences, i.e. all system 10 functions. These switches, typically represented by switch 68 in FIGS. 2 and 3 (discussed hereabove) can be placed at strategic locations within the system 10. Once power is initiated directly or remotely, (as by remote transmitter, direct manual activation, or activation by a timer wheel and so on) such limit switches can readily terminate and activate system 10 lighting and articulation in a series of programmed events, for example: warning amber lights—on/off; articulated arms 42*a,b* and 44*a,b*, extended—retracted; red stop lights, on/off; system 10 lock-down. The portable, mobile signaling system of the type disclosed herein can enjoy a great number of alterations, modifications and customization with respect to mechanical linkages, activation sequencing elements, lighting unit locations, base and wheel designs and so forth without departing from the scope of claims appended hereto. FIG. 6 is a block diagram depicting one method of controlling signal system 10.

FIG. 6 diagrammatically illustrates how this novel signal system 10 can be controlled entirely by remote control through its significant stages "idle, warning, stop and idle." Initially, the user employs the remote control (handheld unit) transmitter 8 to command the control unit C via switches S to activate battery 12 associated with control unit C. This signal places system 10 in its idle disposition, ready for the next command.

When children arrive at a crosswalk to traverse a roadway, the crossing guard serving as traffic manager employs the remote control transmitter 18 to direct control unit C via switches S in receiver 14 to activate warning lights (see 52*a-f* in FIG. 4B). This action places the mobile signal system 10 in its warning disposition as depicted in FIG. 4B. In this mode, the warning lights 52*a-f* typically flash for a period of about 5 seconds or perhaps longer, even 15 to 20 seconds or more. A sufficient warning period generally depends on the traffic speed and other ambient factors. Next, the traffic manager activates the remote control transmitter 18 to command the control unit C via switches S in receiver 14 to deploy stop signal signs 50*a*, 50*b* simultaneously by activating a motor M output shaft 60. This sets into action the mechanical deployment apparatus (gear plate 65 etc.) located on swivel casing 40, and subsequent activation of flashing stop lights 51*a-d*, putting the mobile signal system into its stop disposition. When traffic has come to a halt, signal system 10 remains in traffic blocking mode and children may safely cross the street under continued supervision of the crossing guard.

After completely crossing the street, the traffic manager again employs the remote control transmitter 18 to command control unit C via switches S in receiver 14 to retract stop signal signs 50*a*,50*b*, which action also turns off stop lights 51*a-d*, and returns the signal system 10 to its idle disposition (or park mode). The mobile signal system is now ready for its next command.

Although various embodiments of the present invention have been described in the foregoing detailed description an illustrated in the accompanying drawings, it will be understood that the invention is not limited to the embodiments disclosed, but may assume numerous arrangements, rearrangements, modifications, and substitutions of steps without departing from the spirit of the invention nor from the scope of the following claims.

I claim:

1. A portable signal system configured to operate by remotely transmitted control signals and having an adjustable frontal profile for managing advancing motorists in roadway traffic wherein said system comprises:

a substantially vertical stanchion with a base, said stanchion further defined as including an upper portion and a lower portion with said stanchion lower portion affixed to said base;

said stanchion upper portion including at least one warning light signal element disposed on a first side thereof, the at least one warning light signal element forming a warning light section of said stanchion upper portion and disposed so as to face in a first signaling direction;

pivot bracket elements affixed to said stanchion above said base;

journalled on said pivot bracket elements are proximate ends of a pair of articulated arms constrained for swiveled movement between a folded position wherein distal ends of said arms are disposed relatively adjacent to each other and generally along said first signaling direction defining a first frontal profile width of said portable signal system in said first signaling direction, and an extended position wherein distal ends of said arms are extended substantially away from each other in a direction substantially perpendicular to said first signaling direction and generally defining a second frontal profile width of said portable signal system significantly greater than said first frontal profile width;

affixed at each of said distal ends of said arms is a stop signal sign oriented to face generally perpendicular to said first signaling direction when said arms are swiveled to said folded position, and to face generally in said first signaling direction when said arms are swiveled to said extended position;

each said stop signal sign including at least one stopping light element mounted thereon so as to face in said first signaling direction when said arms are swiveled to said extended position;

a control unit affixed to said stanchion, wherein said control unit includes therein a power source for energizing said at least one warning light signal element, said at least one stopping light element, and said swiveled movement of said pair of articulated arms;

a receiver for said remotely transmitted control signals and having at least one receiver switch for selectively activating said energizing of said at least one warning light signal element, said at least one stopping light element, and said swiveled movement of said pair of articulated arms in response to said transmitted control signals;

whereby said portable signal system can be positioned along a roadway with said stanchion first side facing in said signaling direction opposing oncoming traffic, wherein said stop signal signs are un-viewable by said advancing motorists in said oncoming traffic when said articulated arms are in said folded position and fully viewable by said advancing motorists in said oncoming traffic when said arms are in said extended position.

2. The portable signal system of claim 1 further defined by:

said stanchion upper portion includes a plurality of said warning light signal elements generally vertically disposed along at least said first side of said stanchion.

3. The portable signal system of claim 2 wherein said plurality of warning light signal elements are configured to flash in a pre-selected sequence.

4. The portable signal system of claim 1 further including:

a drive motor affixed to said stanchion and having a drive output;

a gear plate with gear teeth along a peripheral edge thereof, said gear teeth operatively interconnected with said drive output imparting turning movement to the (or to said) gear plate along a forward and reverse pathway;

a pair of drive links each of which is pivotally attached at a first end thereof to said gear plate;

each of said drive links pivotally attached at a second end thereof to a different one of said pair of articulated arms;

whereby said drive links operatively move said arms between said folded and extended positions under force of said drive output thereby increasing said frontal profile width of said signal system in a direction substantially perpendicular to said first signaling direction such that said signaling system is more fully viewable by said advancing motorists in roadway traffic.

5. The portable signal system of claim 4 further including:

an auxiliary limit switch fixed to said stanchion;

said auxiliary limit switch is positioned in said gear plate pathway so as to be engaged by said gear plate during the turning movement thereof;

said at least one auxiliary limit switch is interconnected to said control unit and configured to immediately energize said at least one stopping light element when said arms are in said extended positions.

6. The portable signal system of claim 1 further including:

at least one wheel journalled on said base;

at least one handle element affixed to said stanchion;

whereby said portable signal system can be manually moved on said at least one wheel while guided by said at least one handle element.

7. The portable signal system of claim 6 further defined by:

said at least one wheel is journalled adjacent a first edge of said base;

at least one foot element is affixed to said base adjacent a second edge of said base opposite said first edge;

whereby said signal system can grasped by said at least one handle element and manually tilted on said at least one wheel so as to lift said at least one foot element, freeing the signal system for immediate portability.

8. The portable signal system of claim 1 further including an electromagnetic anchoring mechanism for temporary attachment to external ferrous surfaces along said roadway, said mechanism characterized by:

said stanchion base including a lower surface provided with at least one support pin extending therefrom, said at least one support pin having an enlarged end portion;

at least one compression spring surrounding said at least one pin and supported by said pin enlarged end portion;

an electromagnetic plate with at least one pin passage therethrough associated with said at least one pin;

said electromagnetic plate normally supported on said base lower surface by force of said at least one compression spring;

said electromagnetic plate interconnected to said power source for energization thereby;

whereby energization of said electromagnetic plate enables said plate to overcome the force of said compression spring and attach to said external ferrous metal surfaces.

9. The portable signal system of claim 1 further defined by:

said power source includes a battery;

said power source further includes a solar panel affixed to said stanchion and wired to said control unit for battery charge maintenance.

10. The portable system of claim 1 further characterized by:

said bracket elements affixed at a location on said stanchion generally below said at least one warning light signal element.

* * * * *